US007182134B2

(12) United States Patent
Wetzel et al.

(10) Patent No.: US 7,182,134 B2
(45) Date of Patent: Feb. 27, 2007

(54) INTELLIGENT WELL SYSTEM AND METHOD

(75) Inventors: Rodney J. Wetzel, Katy, TX (US); Sudhir Pai, Houston, TX (US); David R. Smith, College Station, TX (US); Peter V. Howard, Bellville, TX (US); Craig D. Johnson, Montgomery, TX (US); Jake A. Danos, Youngsville, LA (US); Patrick W. Bixenman, Bartlesville, OK (US)

(73) Assignee: Schlumberger Technology Corporation, Sugar Land, TX (US)

( * ) Notice: Subject to any disclaimer, the term of this patent is extended or adjusted under 35 U.S.C. 154(b) by 32 days.

(21) Appl. No.: 10/797,161

(22) Filed: Mar. 10, 2004

(65) Prior Publication Data

US 2004/0173350 A1 Sep. 9, 2004

Related U.S. Application Data

(60) Division of application No. 10/125,447, filed on Apr. 18, 2002, now Pat. No. 6,789,621, which is a continuation-in-part of application No. 10/021,724, filed on Dec. 12, 2001, now Pat. No. 6,695,054, which is a continuation-in-part of application No. 10/079,670, filed on Feb. 20, 2002, now Pat. No. 6,848,510, which is a continuation-in-part of application No. 09/973,442, filed on Oct. 9, 2001, now Pat. No. 6,799,637, which is a continuation-in-part of application No. 09/981,072, filed on Oct. 16, 2001, now Pat. No. 6,681,854, which is a continuation-in-part of application No. 09/631,851, filed on Aug. 3, 2000, now abandoned, which is a continuation-in-part of application No. 09/732,134, filed on Dec. 7, 2000, now Pat. No. 6,446,729.

(60) Provisional application No. 60/354,552, filed on Feb. 6, 2002, provisional application No. 60/361,509, filed on Mar. 4, 2002.

(51) Int. Cl.
*E21B 43/04* (2006.01)
*E21B 47/00* (2006.01)

(52) U.S. Cl. ..... 166/250.01; 166/51; 166/66; 166/278; 166/305.1

(58) Field of Classification Search ..... 166/51, 166/278, 305.1, 66, 250.01
See application file for complete search history.

(56) References Cited

U.S. PATENT DOCUMENTS 4,832,121 A * 5/1989 Anderson ..... 166/250.09

(Continued)

FOREIGN PATENT DOCUMENTS

EP 0779409 A1 6/1997

OTHER PUBLICATIONS

Docket Sheet for *Memry Corporation* v. *Kentucky Oil Technology*, N.V., Case No. H-04-1959 (S.D. Tex.) (PACER Jun. 2, 2005) (5 pages).

(Continued)

*Primary Examiner*—Hoang Dang
(74) *Attorney, Agent, or Firm*—Robert A. Van Someren; Bryan P. Galloway; Jaime A. Castano

(57) ABSTRACT

An intelligent well system and method has a sand face completion and a monitoring system to monitor application of a well operation. Various equipment and services may be used. In another aspect, the invention provides a monitoring system for determining placement of a well treatment. Yet another aspect of the invention is an instrumented sand screen. Another aspect is a connector for routing control lines. It is emphasized that this abstract is provided to comply with the rules requiring an abstract which will allow a searcher or other reader to quickly ascertain the subject matter of the technical disclosure. It is submitted with the understanding that it will not be used to interpret or limit the scope or meaning of the claims. 37 CFR 1.72(b)

26 Claims, 8 Drawing Sheets

U.S. PATENT DOCUMENTS

| | | | | |
|---|---|---|---|---|
| 5,485,745 | A * | 1/1996 | Rademaker et al. | 73/152.39 |
| 5,992,250 | A * | 11/1999 | Kluth et al. | 73/866.5 |
| 6,004,639 | A * | 12/1999 | Quigley et al. | 428/36.3 |
| 6,355,928 | B1 * | 3/2002 | Skinner et al. | 250/269.1 |
| 6,554,064 | B1 * | 4/2003 | Restarick et al. | 166/250.01 |
| 6,561,278 | B2 * | 5/2003 | Restarick et al. | 166/378 |
| 6,847,034 | B2 * | 1/2005 | Shah et al. | 250/269.1 |
| 2002/0060070 | A1 * | 5/2002 | Ramos et al. | 166/285 |

OTHER PUBLICATIONS

Docket Sheet for *Memry Corporation* v. *Kentucky Oil Technology*, N.V., Case No. C-04-03843, (N.D. Cal.) (PACER Aug. 11, 2005) (23 pages).

Communication from United States District Court Transferring Case, *Memry Corporation* v. *Kentucky Oil Technology*, N.V., Case No. H-04-1959 (S.D. Tex.), dated Sep. 7, 2004 (1 page).

Plaintiffs' Original Complaint, *Memry Corporation* v. *Kentucky Oil Technology*, N.V., Case No. H-04-1959, (S.D. Tex.), filed May 14, 2004 (20 pages).

Defendants' Motions (1) to Dismiss the Complaint for Insufficiency of Process and Lack of Personal Jurisdiction, (2) to Dismiss Counts I-III of the Complaint for Failure to State a Claim, and (3) in the Alternative, to Transfer This Action to the Federal District Court for the Northern Distric of California, *Memry Corporation* v. *Kentucky Oil Technology*, N.V., Case No. H-04-1959, (S.D. Tex.), filed Jul. 7, 2004 (49 pages), 53 pages?

Plaintiffs' First Amended Complaint, *Memry Corporation* v. *Kentucky Oil Technology*, N.V., Case No. C-04-03843, (N.D. Cal.), filed Aug. 19, 2004 (20 pages).

Answer of Defendants and Counterclaims of Kentucky Oil Technology N.V. Against Memry Corporation and Schlumberger Technology Corporation, *Memry Corporation* v. *Kentucky Oil Technology*, N.V., Case No. C-04-03843, (N.D. Cal.) filed Nov. 2, 2004 (20 pages).

Plaintiff and Counterdefendant Memry Corporation's Answer to Kentucky Oil Technology N.V.'s Counterclaims and Demand for Jury Trial, *Memry Corporation* v. *Kentucky Oil Technology*, N.V., Case No. C-04-03843, (N.D. Cal.), filed Dec. 3, 2004 (10 pages).

Schlumberger Technology Corportation's Notice of Motion and Motion to Dismiss Kentucky Oil Technology's Third, Fourth, Fifth, and Sixith Counterclaims; and Memorandum of Points and Authorities, *Memry Corporation* v. *Kentucky Oil Technology*, N.V., Case No. C-04-03843, (N.D. Cal.), filed Jan. 24, 2005 (32 pages).

[Proposed] Oder Granting Schlumberger Technology Corporation's Motion to Dismiss Kentucky Oil Technology's Third, Fourth, Fifth, and Sixth Counterclaims, *Memry Corporation* v. *Kentucky Oil Technology*, N.V., Case No. C-04-03843, (N.D. Cal.), filed Jan. 24, 2005 (3 pages).

First Amended Counterclaims of Kentucky Oil Technology N.V. Against Memry Corporation and Schlumberger Technology Corporation, *Memry Corporation* v. *Kentucky Oil Technology*, N.V., Case No. C-04-03843, (N.D. Cal.), filed Feb. 9, 2005 (16 pages).

Schlumberger Technology Corporation's Notice of Motion and Motion to Dismiss Kentucky Oil Technology's First Amended Third, Fourth, Fifth, and Sixth Counterclaims; and Memorandum of Points and Authorities, *Memry Corporation* v. *Kentucky Oil Technology*, N.V., Case No. C-04-03843, (N.D. Cal.), filed Feb. 24, 2005 (32 pages).

Request for Judicial Notice in Support of Schlumberger Technology Corportation's Motion to Dismiss Kentucky Oil Technology's First Amended Third, Fourth, Fifth, and Sixth Counterclaims, *Memry Corporation* v. *Kentucky Oil Technology*, N.V., Case No. C-04-03843, (N.D. Cal.), filed Feb. 24, 2005 (3 pages).

[Proposed] Order Granting Schlumberger Technology Corporation's Motion to Dismiss Kentucky Oil Technology's First Amended Third, Fourth, Fifth, and Sixth Counterclaims, *Memry Corporation* v. *Kentucky Oil Technology*, N.V., Case No. C-04-03843, (N.D. Cal.), filed Feb. 24, 2005 (3 pages).

Plaintiff and Counterdefendant Memry Corporation's Notice of Motion and Motion to Dismiss Kentucky Oil Technology's Third, Fourth, Fifth, and Sixth Counterclaims; and Memorandum of Points and Authorities, *Memry Corporation* v. *Kentucky Oil Technology*, N.V., Case No. C-04-03843, (N.D. Cal.), filed Feb. 25, 2005 (29 pages).

Request for Judicial Notice in Support of Memry Corporation's Motion to Dismiss Kentucky Oil Technology's Third, Fourth, Fifth, and Sixth Counterclaims, *Memry Corporation* v. *Kentucky Oil Technology*, N.V., Case No. C-04-03843, (N.D. Cal.), filed Feb. 25, 2005 (3 pages).

[Proposed] Order Granting Memory Corporation's Motion to Dismiss Kentucky Oil Technology's Third Fourth, Fifth, and Sixth Counterclaims, *Memry Corporation* v. *Kentucky Oil Technology*, N.V., Case No. C-04-03843, (N.D. Cal.), filed Feb. 25, 2005 (3 pages).

Opposition of Kentucky Oil to Motions of Memry Corporation and Schlumberger Technology Corporation to Dismiss First Amended Counterclaims, *Memry Corporation* v. *Kentucky Oil Technology*, N.V., Case No. C-04-03843, (N.D. Cal.), filed Mar. 11, 2005 (29 pages).

Kentucky Oil's Opposition to Counterdefendants's Requests for Judicial Notice in Support of Their Motions to Dismiss Kentucky Oil Technology's First Amended Third, Fourth, Fifth, and Sixth Counterclaims, *Memry Corporation* v. *Kentucky Oil Technology*, N.V., Case No. C-04-03843, (N.D. Cal.), filed Mar. 11, 2005 (3 pages).

Plaintiff and Counterdefendant Memry Corporation's Reply in Support of Motion to Dismiss Kentucky Oil Technology's Third, Fourth, Fifth, and Sixth Counterclaims, *Memry Corporation* v. *Kentucky Oil Technology*, N.V., Case No. C-04-03843, (N.D. Cal.), filed Mar. 18, 2005 (9 pages).

Plaintiff and Counterdefendant Memry Corporation's Reply in Support of Request for Judicial Notice, *Memry Corporation* v. *Kentucky Oil Technology*, N.V., Case No. C-04-03843, (N.D. Cal.), filed Mar. 18, 2005 (4 pages).

Reply of Schlumberger Technology Corporation to Kentucky Oil Technology's Opposition to First Ammended, Third, Fourth, Fifth, and Sixth Counterclaims, *Memry Corporation* v. *Kentucky Oil Technology*, N.V., Case No. C-04-03843, (N.D. Cal.), filed Mar. 18, 2005 (17 pages).

Schlumberger's Response to Kentucky Oil's Opposition to Counterdefendants' Requests for Judicial Notice, *Memry Corporation* v. *Kentucky Oil Technology*, N.V., Case No. C-04-03843, (N.D. Cal.), filed Mar. 18, 2005 (3 pages).

Schlumberger's Notice of Motion and Motion to Strike Exhibits 1, 2, and 4 to the Declaration of Nicola A. Pisano, *Memry Corporation* v. *Kentucky Oil Technology*, N.V., Case No. C-04-03843, (N.D. Cal.), filed Mar. 18, 2005 (3 pages).

Kentucky Oil's Opposition to STC's Motion to Strike Exhibits 1, 3 and 4 to the Declaration of Nicola A. Pisano, *Memry Corporation* v. *Kentucky Oil Technology*, N.V., Case No. C-04-03843, (N.D. Cal.), filed Mar. 25, 2005 (3 pages).

Kentucky Oil's Notice of Motion and Motion to Strike Declaration of Benjamin Holl and Portions of Counterdefendants' Reply Briefs, *Memry Corporation* v. *Kentucky Oil Technology*, N.V., Case No. C-04-03843, (N.D. Cal.), filed Mar. 25, 2005 (4 pages).
[Proposed] Order Granting Kentucky Oil's Motion to Strike Declaration of Benjamin Hool and Portions of Counterdefendants' Reply Briefs, *Memry Corporation* v. *Kentucky Oil Technology*, N.V., Case No. C-04-03843, (N.D. Cal.), filed Mar. 25, 2005 (2 pages).
Order Granting in Part and Denying in Part Counterdefendants' Motion to Dismiss, *Memry Corporation* v. *Kentucky Oil Technology*, N.V., Case No. C-04-03843, (N.D. Cal.), filed Apr. 8, 2005 (26 pages).
Plaintiff and Counterdefendant Memry Corporation's Replay to Kentucky Oil Technology N.V.'s Counterclaims and Demand for Jury Trial, *Memry Corporation* v. *Kentucky Oil Technology*, N.V., Case No. C-04-03843, (N.D. Cal.), filed Apr. 18, 2005 (8 pages).
Second Amended Counterclaims of Kentucky Oil Technology N.V. Against Memry Corporation and Schlumberger Technology Corporation, *Memry Corporation* v. *Kentucky Oil Technology*, N.V., Case No. C-04-03843, (N.D. Cal.), filed May. 6, 2005 (20 pages).
Plaintiff Memry Corporation's Reply to Kentucky Oil Technology N.V.'s Second Amended Counterclaims and Demand for Jury Trial, *Memry Corporation* v. *Kentucky Oil Technology*, N.V., Case No. C-04-03843, (N.D. Cal.), filed Jun. 3, 2005 (9 pages).
Schlumberger Technology Corporation's Notice of Motion and Motion to Dismiss the Fourth, Fifth, Sixth, Seventh and Eighth Counterclaims in Kentucky Oil Technology's Second Amended Counterclaims, *Memry Corporation* v. *Kentucky Oil Technology*, N.V., Case No. C-04-03843, (N.D. Cal.), filed Jun. 3, 2005 (18 pages).
Opposition of Kentucky Oil Technology to Schlumberger Technology Corporation's Motion to Dismiss Kentucky Oil's Second Amended Counterclaims, *Memry Corporation* v. *Kentucky Oil Technology*, N.V., Case No. C-04-03843, (N.D. Cal.), filed Jun. 17, 2005 (16 pages).
Schlumberger Technology Corporation's Reply Brief in Support of its Motion to Dismiss the Fourth, Fifth, Sixth, Seventh and Eighth Counterclaims in Kentucky Oil Technology's Second Amended Counterclaims, *Memry Corporation* v. *Kentucky Oil Technology*, N.V., Case No. C-04-03843, (N.D. Cal.), filed Jun. 24, 2005 (11 pages).
Order Granting in Part and Denying In Part STC's Motion to Dismiss *Memry Corporation* v. *Kentucky Oil Technology*, N.V., Case No. C-04-03843, (N.D. Cal.), filed Jul. 14, 2005 (8 pages).
Schlumberger Technology Corperation's Answer to Kentucky Oil Technology's Second Amended Counterclaims, *Memry Corporation* v. *Kentucky Oil Technology*, N.V., Case No. C-04-03843, (N.D. Cal.), filed Jul. 28, 2005 (8 pages).
Notice o Motion and Motion by Kentucky Oil To Compel Production of Documents by Schlumberger Technology Corporation Pursuant to Fed. R. Civ. Rule 37; Memorandum of Points and Authorities in Support Thereof; Declaration of Michael Bierman, *Memry Corporation* v. *Kentucky Oil Technology*, N.V., Case No. C-04-03843, (N.D. Cal.), filed Jul. 28, 1005 (32 pages).
Schlumberger Technology Corporation's Opposition to Kentucky Oil Technology's Motion to Compel, *Memry Corporation* v. *Kentucky Oil Technology*, N.V., Case No. C-04-03843, (N.D. Cal.), filed Aug. 4, 2005 (21 pages).
Declaration of David B. Moyer in Support of Schlumberger Technology Corporation's Opposition to Kentucky Oil Technology's Motion to Compel, *Memry Corporation* v. *Kentucky Oil Technology*, N.V., Case No. C-04-03843, (N.D. Cal.), filed Aug. 4, 2005 (52 pages).
Kentucky Oil's Reply in Support of Motion to Compel, *Memry Corporation* v. *Kentucky Oil Technology*, N.V., Case No. C-04-03843, (N.D. Cal.), filed Aug. 10, 2005 (18 pages).
Declaration of Nicola A. Pisano in Support of Kentucky Oil's Motion to Compel, *Memry Corporation* v. *Kentucky Oil Technology*, N.V., Case No. C-04-03843, (N.D. Cal.), filed Aug. 10, 2005 (69 pages).
Order Granting Kentucky Oil's Motion to Compel Production of Documents, *Memry Corporation* v. *Kentucky Oil Technology*, N.V., Case No. C-04-03843, (N.D. Cal.), filed Aug. 17, 2005 (8 pages) (107 pages).

* cited by examiner

INTELLIGENT WELL SYSTEM AND METHOD

CROSS-REFERENCE TO RELATED APPLICATION

This is a divisional of U.S. Ser. No. 10/125,447, filed Apr. 18, 2002 now U.S. Pat. No. 6,789,621, which is a continuation-in-part of U.S. Ser. No. 10/021,724 filed Dec. 12, 2001 now U.S. Pat. No. 6,695,054, U.S. Ser. No. 10/079,670, filed Feb. 20, 2002 now U.S. Pat. No. 6,848,510, U.S. Ser. No. 09/973,442, filed Oct. 9, 2001 now U.S. Pat. No. 6,799,637, U.S. Ser. No. 09/981,072, filed Oct. 16, 2001 now U.S. Pat. No. 6,681,854, U.S. Ser. No. 09/631,851, filed Aug. 3, 2000 now abandoned, U.S. Ser. No. 09/732,134, filed Dec. 7, 2000 now U.S. Pat. No. 6,446,729. The continuation-in-part, U.S. Ser. No. 10/125,447, also is based on and claims priority to U.S. provisional application Ser. Nos. 60/354,552, filed Feb. 6, 2002 and 60/361,509 filed Mar. 4, 2002.

BACKGROUND OF THE INVENTION

1. Field of Invention

The present invention relates to the field of well monitoring. More specifically, the invention relates to equipment and methods for real time monitoring of wells during various processes as well.

2. Related Art

There is a continuing need to improve the efficiency of producing hydrocarbons and water from wells. One method to improve such efficiency is to provide monitoring of the well so that adjustments may be made to account for the measurements. Accordingly, there is a continuing need to provide such systems. Likewise, there is a continuing need to improve the placement of well treatments.

SUMMARY

In general, according to one embodiment, the present invention provides monitoring equipment and methods for use in connection with wells. Another aspect of the invention provides specialized equipment for use in a well.

Other features and embodiments will become apparent from the following description, the drawings, and the claims.

BRIEF DESCRIPTION OF THE DRAWINGS

The manner in which these objectives and other desirable characteristics can be obtained is explained in the following description and attached drawings in which.

It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

In the following description, numerous details are set forth to provide an understanding of the present invention. However, it will be understood by those skilled in the art that the present invention may be practiced without these details and that numerous variations or modifications from the described embodiments may be possible.

In this description, the terms "up" and "down"; "upward" and downward"; "upstream" and "downstream"; and other like terms indicating relative positions above or below a given point or element are used in this description to more clearly described some embodiments of the invention. However, when applied to apparatus and methods for use in wells that are deviated or horizontal, such terms may refer to a left to right, right to left, or other relationship as appropriate.

Figure 1:
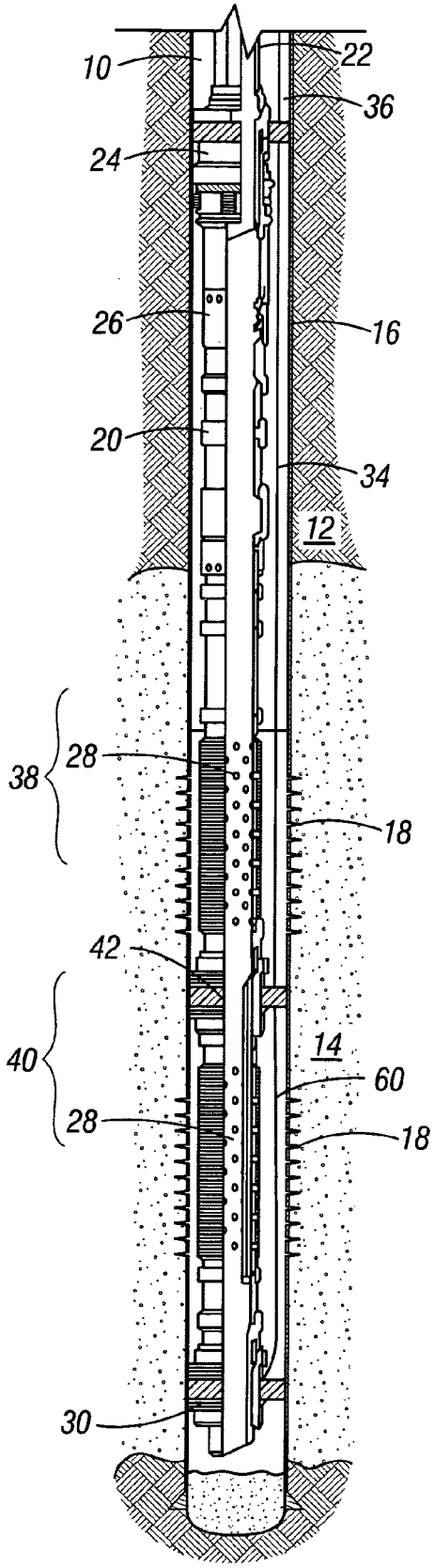
FIG. 1 illustrates a well having a gravel pack completion with a control line therein.

One aspect of the present invention is the use of a sensor, such as a fiber optic distributed temperature sensor, in a well to monitor an operation performed in the well, such as a gravel pack as well as production from the well. Other aspects comprise the routing of control lines and sensor placement in a sand control completion. Referring to the attached drawings, FIG. 1 illustrates a wellbore 10 that has penetrated a subterranean zone 12 that includes a productive formation 14. The wellbore 10 has a casing 16 that has been cemented in place. The casing 16 has a plurality of perforations 18 which allow fluid communication between the wellbore 10 and the productive formation 14. A well tool 20, such as a sand control completion, is positioned within the casing 16 in a position adjacent to the productive formation 14, which is to be gravel packed.

The present invention can be utilized in both cased wells and open hole completions. For ease of illustration of the relative positions of the producing zones, a cased well having perforations will be shown.

In the example sand control completion, the well tool 20 comprises a tubular member 22 attached to a production packer 24, a cross-over 26, and one or more screen elements 28. The tubular member 22 can also be referred to as a tubing string, coiled tubing, workstring or other terms well known in the art. Blank sections 32 of pipe may be used to properly space the relative positions of each of the components. An annulus area 34 is created between each of the components and the wellbore casing 16. The combination of the well tool 20 and the tubular string extending from the well tool to the surface can be referred to as the production string. FIG. 1 shows an optional lower packer 30 located below the perforations 18.

In a gravel pack operation the packer element 24 is set to ensure a seal between the tubular member 22 and the casing 16. Gravel laden slurry is pumped down the tubular member 22, exits the tubular member through ports in the cross-over 26 and enters the annulus area 34. Slurry dehydration occurs when the carrier fluid leaves the slurry. The carrier fluid can leave the slurry by way of the perforations 18 and enter the formation 14. The carrier fluid can also leave the slurry by way of the screen elements 28 and enter the tubular member 22. The carrier fluid flows up through the tubular member 22 until the cross-over 26 places it in the annulus area 36 above the production packer 24 where it can leave the wellbore 10 at the surface. Upon slurry dehydration the gravel grains should pack tightly together. The final gravel filled annulus area is referred to as a gravel pack. In this example, an upper zone 38 and a lower zone 40 are each perforated and gravel packed. An isolation packer 42 is set between them.

As used herein, the term "screen" refers to wire wrapped screens, mechanical type screens and other filtering mechanisms typically employed with sand screens. Screens generally have a perforated base pipe with a filter media (e.g., wire wrapping, mesh material, pre-packs, multiple layers, woven mesh, sintered mesh, foil material, wrap-around slotted sheet, wrap-around perforated sheet, MESHRITE manufactured by Schlumberger, or a combination of any of these media to create a composite filter media and the like) disposed thereon to provide the necessary filtering. The filter media may be made in any known manner (e.g., laser cutting, water jet cutting and many other methods). Sand screens need to have openings small enough to restrict gravel flow, often having gaps in the 60–120 mesh range, but other sizes may be used. The screen element 28 can be referred to as a screen, sand screen, or a gravel pack screen. Many of the common screen types include a spacer that offsets the screen member from a perforated base tubular, or base pipe, that the screen member surrounds. The spacer provides a fluid flow annulus between the screen member and the base tubular. Screens of various types commonly known to those skilled in the art. Note that other types of screens will be discussed in the following description. Also, it is understood that the use of other types of base pipes, e.g. slotted pipe, remains within the scope of the present invention. In addition, some screens 28 have base pipes that are unperforated along their length or a portion thereof to provide for routing of fluid in various manners and for other reasons.

Figure 2:
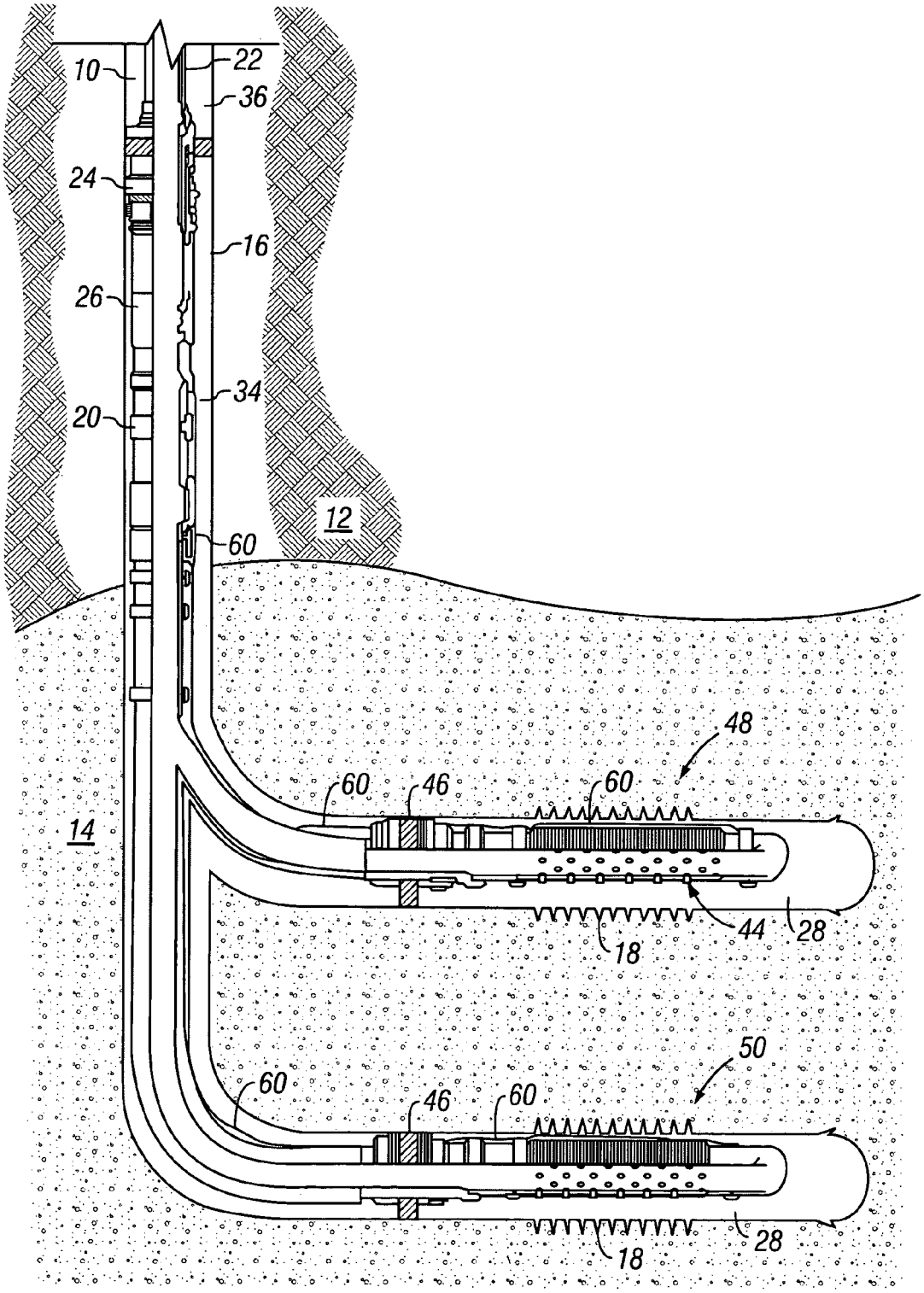
FIG. 2 illustrates a multilateral well having a gravel packed lateral and control lines extending into both laterals.

Note that numerous other types of sand control completions and gravel pack operations are possible and the above described completion and operation are provided for illustration purposes only. As an example, FIG. 2 illustrates one particular application of the present invention in which two lateral wellbores are completed, an upper lateral 48 and a lower lateral 50. Both lateral wellbores are completed with a gravel pack operation comprising a lateral isolation packer 46 and a sand screen assembly 28.

Figure 3:
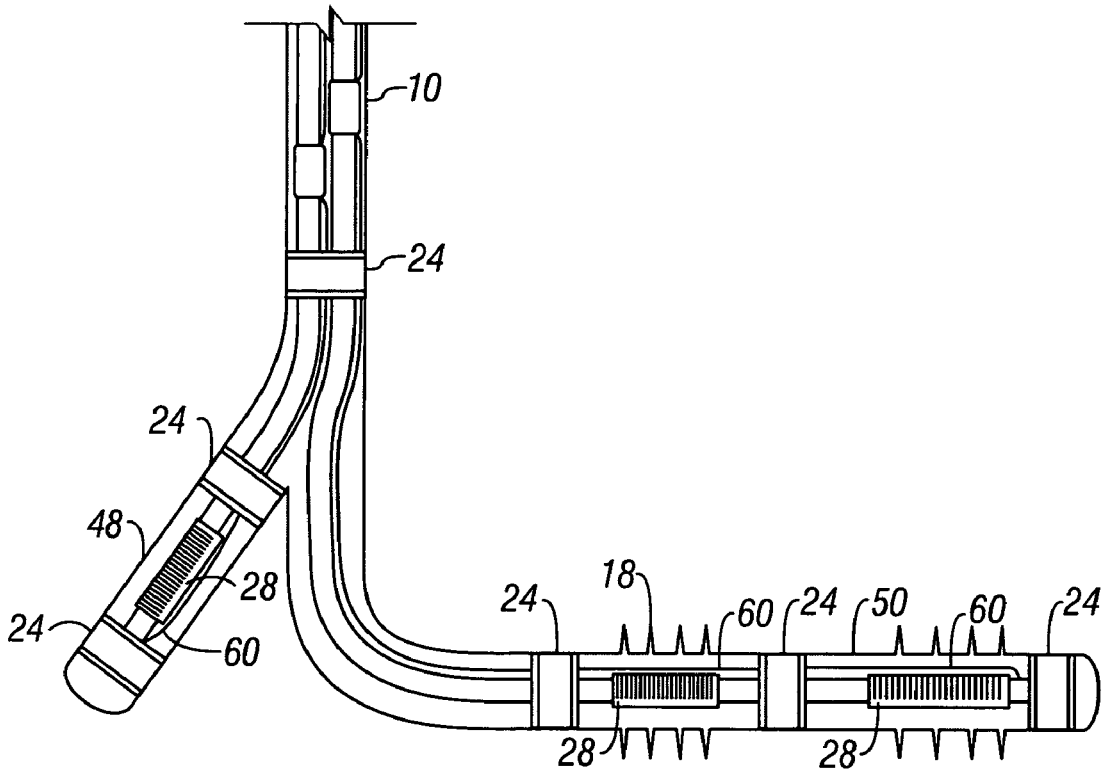
FIG. 3 illustrates a multilateral well having a plurality of zones in one of the laterals and sand face completions with control lines extending therein.

Similarly, FIG. 3 shows another exemplary embodiment in which two laterals are completed with a sand control completion and a gravel pack operation. The lower lateral 50 in FIG. 3 has multiple zones isolated from one another by a packer 42.

In each of the examples shown in FIGS. 1 through 3, a control line 60 extends into the well and is provided adjacent to the screen 28. Although shown with the control line 60 outside the screen 28, other arrangements are possible as disclosed herein. Note that other embodiments discussed herein will also comprise intelligent completions devices 62 in the gravel pack, the screen 28, or the sand control completion.

Examples of control lines 60 are electrical, hydraulic, fiber optic and combinations of thereof. Note that the communication provided by the control lines 60 may be with downhole controllers rather than with the surface and the telemetry may include wireless devices and other telemetry devices such as inductive couplers and acoustic devices. In addition, the control line itself may comprise an intelligent completions device as in the example of a fiber optic line that provides functionality, such as temperature measurement (as in a distributed temperature system), pressure measurement, sand detection, seismic measurement, and the like.

Examples of intelligent completions devices that may be used in the connection with the present invention are gauges, sensors, valves, sampling devices, a device used in intelligent or smart well completion, temperature sensors, pressure sensors, flow-control devices, flow rate measurement devices, oil/water/gas ratio measurement devices, scale detectors, actuators, locks, release mechanisms, equipment sensors (e.g., vibration sensors), sand detection sensors, water detection sensors, data recorders, viscosity sensors, density sensors, bubble point sensors, pH meters, multiphase flow meters, acoustic sand detectors, solid detectors, composition sensors, resistivity array devices and sensors, acoustic devices and sensors, other telemetry devices, near infrared sensors, gamma ray detectors, $H_2S$ detectors, $CO_2$ detectors, downhole memory units, downhole controllers, perforating devices, shape charges, firing heads, locators, and other downhole devices. In addition, the control line itself may comprise an intelligent completions device as mentioned above. In one example, the fiber optic line provides a distributed temperature functionality so that the temperature along the length of the fiber optic line may be determined.

Figure 4:
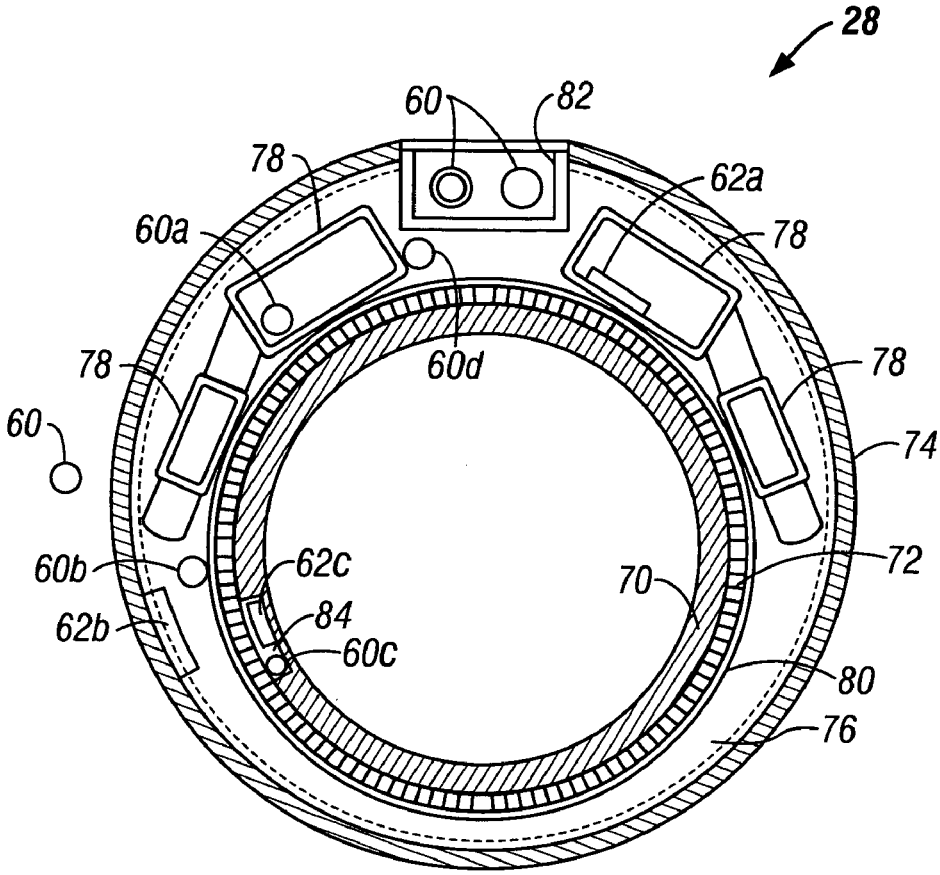
FIG. 4 is a cross sectional view of a sand screen of the present invention showing numerous alternative designs.

FIG. 4 is a cross sectional view of one embodiment of a screen 28 of the present invention. The sand screen 28 generally comprises a base pipe 70 surrounded by a filter media 72. To provide for the flow of fluid into the base pipe 70, it has perforations therethrough. The screen 28 is typical to those used in wells such as those formed of a screen wrap or mesh designed to control the flow of sand therethrough. Surrounding at least a portion of the base pipe 70 and filter media 72 is a perforated shroud 74. The shroud 74 is attached to the base pipe 70 by, for example, a connecting ring or other connecting member extending therebetween and connected by a known method such as welding. The shroud 74 and the filter media 72 define a space therebetween 76.

In the embodiment shown in FIG. 4, the sand screen 28 comprises a plurality of shunt tubes 78 (also known as alternate paths) positioned in the space 76 between the screen 28 and the shroud 74. The shunt tubes 78 are shown attached to the base pipe 70 by an attachment ring 80. The methods and devices of attaching the shunt tubes 78 to the base pipe 70 may be replaced by any one of numerous equivalent alternatives, only some of which are disclosed in the specification. The shunt tubes 78 can be used to transport gravel laden slurry during a gravel pack operation, thus reducing the likelihood of gravel bridging and providing improved gravel coverage across the zone to be gravel packed. The shunt tubes 78 can also be used to distribute treating fluids more evenly throughout the producing zone, such as during an acid stimulation treatment.

The shroud 74 comprises at least one channel 82 therein. The channel 82 is an indented area in the shroud 74 that extends along its length linearly, helically, or in other traversing paths. The channel 82 in one alternative embodiment has a depth sufficient to accommodate a control line 60 therein and allow the control line 60 to not extend beyond the outer diameter of the shroud 74. Other alternative embodiments may allow a portion of the control line 60 to extend from the channel 82 and beyond the outer diameter of the shroud 74 without damaging the control line 60. In another alternative, the channel 82 includes an outer cover (not shown) that encloses at least a portion of the channel 82. To protect the control line 60 and maintain it in the channel 82, the sand screen 28 may comprise one or more cable protectors, or restraining elements, or clips.

FIG. 4 also shows other alternative embodiments for routing of control lines 60 and for placement of intelligent completions devices 62 such as sensors therein. As shown in previous FIGS. the control line 60 may extend outside of the sand screen 28. In one alternative embodiment, a control line 60*a* extends through one or more of the shunt tubes 78. In another embodiment, the control line 60*b* is placed between the filter media 72 and the shroud 74 in the space 76. FIG. 4 shows another embodiment in which a sensor 62*a* is placed in a shunt tube 78 as well as a sensor 62*b* attached to the shroud 74. Note that an array of such sensors 62*a* may be placed along the length of the sand screen 28. In another alternative embodiment, the base pipe 70 may have a passageway 84, or groove, therein through which a control line 60*c* may extend an in which an intelligent completions device 62*c* may be placed. The passageway 84 may be placed internally in the base pipe 70, on an inner surface of the base pipe 70, or on an outer surface of the base pipe 70 as shown in FIG. 4.

Figure 5:
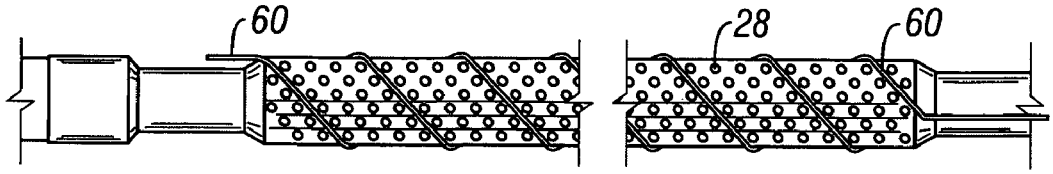
FIG. 5 is a side elevational view of a sand screen of the present invention showing a helical routing of a control line along a sand screen.

Note that the control line 60 may extend the full length of the screen 28 or a portion thereof. Additionally, the control line 60 may extend linearly along the screen 28 or follow an arcuate path. FIG. 5 illustrates a screen 28 having a control line 60 that is routed in a helical path along the screen 28. In one embodiment, the control line 60 comprises a fiber optic line that is helically wound about the screen 28 (internal or external to the screen 28). In this embodiment, a fiber optic line that comprises a distributed temperature system, or that provides other functionality, the resolution at the screen is increased. Other paths about the screen 28 that increase the length of the fiber optic line per longitudinal unit of length of screen 28 will also serve to increase the resolution of the functionality provided by the fiber optic line.

Figure 6:
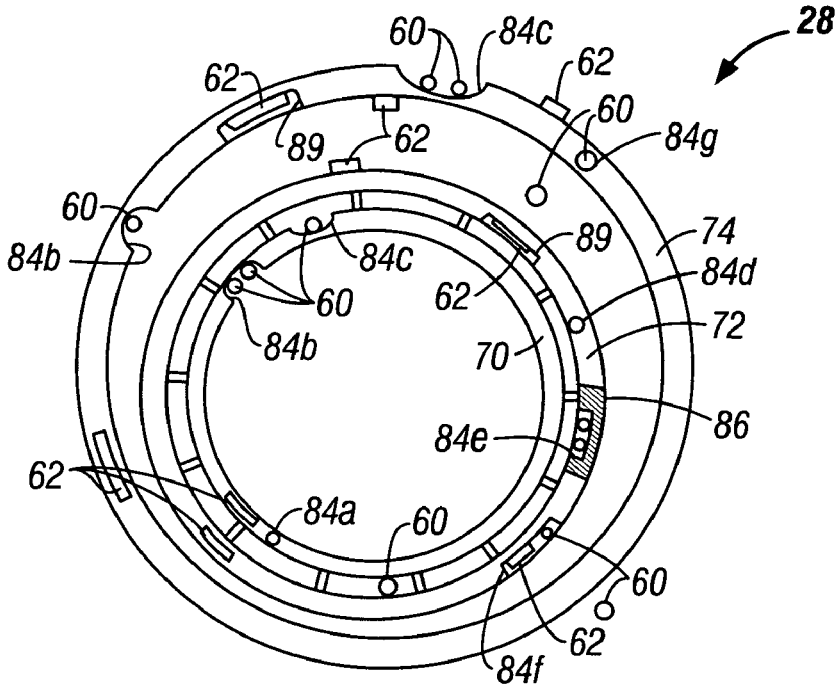
FIGS. 6 through 8 are cross sectional views of a sand screen of the present invention showing numerous alternative designs.
Figure 7:
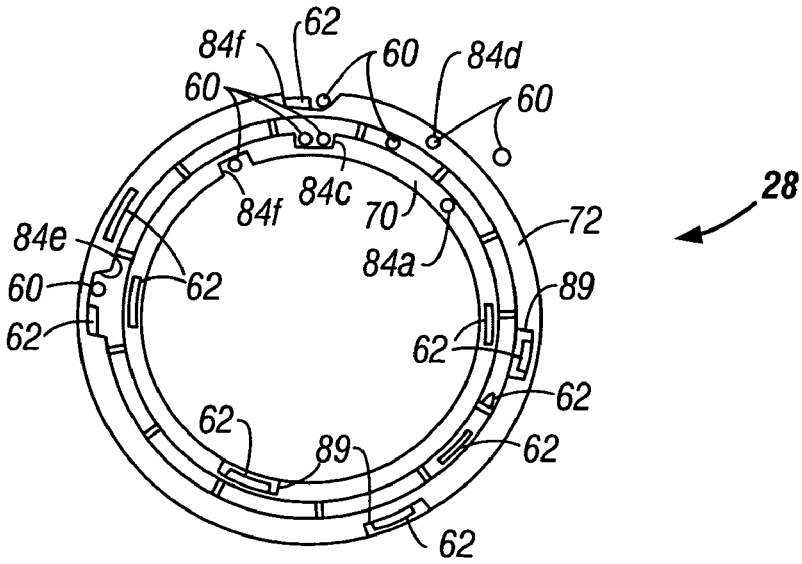

FIGS. 6 and 7 illustrate a number of alternative embodiments for placement of control lines 60 and intelligent completions device 62. FIG. 6 shows a sand screen 28 that has a shroud 74, whereas the embodiment of FIG. 7 does not have a shroud 74.

In both FIGS. 6 and 7, the control line 60 may be routed through the base pipe 70 through an internal passageway 84*a*, a passageway 84*b* formed on an internal surface of the base pipe 70, or a passageway 84*c* formed on an external surface of the base pipe 70. In one alternative embodiment, the base pipe 70 (or a portion thereof) is formed of a composite material. In other embodiments, the base pipe 70 is formed of a metal material. Similarly, the control line 60 may be routed through the filter media 72 through an internal passageway 84*d*, a passageway 84*e* formed on an internal surface of the filter media 72, or a passageway 84*f* formed on an external surface of the filter media 72. Likewise, the control line 60 may be routed through the shroud 74 through an internal passageway 84*g*, a passageway 84*h* formed on an internal surface of the shroud 74, or a passageway 84*i* formed on an external surface of the shroud 74. The shroud 74 may be formed of a metal or composite material. In addition, the control line 60 may also extend between the base pipe 70 and the filter media 72, between the filter media 72 and the shroud 74, or outside the shroud 74. In one alternative embodiment, the filter media has an impermeable portion 86, through which flow is substantially prevented, and the control line 60 is mounted in that portion 86. Additionally, the control line 60 may be routed through the shunt tubes 78 or along the side of the shunt tubes 78 (60*d* in FIG. 4). Combinations of these control line 60 routes may also be used (e.g., a particular device may have control lines 60 extending through a passageway formed in the base pipe 70 and through a passageway formed in the shroud 74). Each position has certain advantages and may be used depending upon the specific application.

Likewise, FIGS. 6 and 7 show a number of alternatives for positioning of an intelligent completions device 62 (e.g., a sensor). In short, the intelligent completions device 62 may be placed within the walls of the various components (the base pipe 70, the filter media 72, and the shroud 74, the shunt tube 78), on an inner surface or outer surface of the components (70, 72, 74, 78), or between the components (70, 72, 74, 78). Also, the components may have recesses 89 formed therein to house the intelligent completions device 62. Each position has certain advantages and may be used depending upon the specific application.

Figure 8:
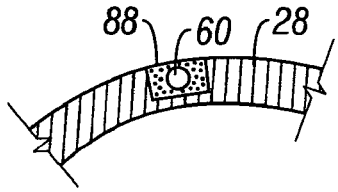

In the alternative embodiment of FIG. 8, the control line 60 is placed in a recess in one of the components (70, 72, 74, 78). A material filler 88 is placed in the recess to mold the control line in place. As an example, the material filler 88 may be an epoxy, a gel that sets up, or other similar material. In one embodiment, the control line 60 is a fiber optic line that is molded to, or bonded to, a component (70, 72, 74, 78) of the screen 28. In this way, the stress and/or strain applied to the screen 28 may be detected and measured by the fiber optic line. Further, the fiber optic line may provide seismic measurements when molded to the screen 28 (or other downhole component or equipment) in this way.

In addition to conventional sand screen completions, the present invention is also useful in completions that use expandable tubing and expandable sand screens. As used herein an expandable tubing 90 comprises a length of expandable tubing. The expandable tubing 90 may be a solid expandable tubing, a slotted expandable tubing, an expandable sand screen, or any other type of expandable conduit. Examples of expandable tubing are the expandable slotted liner type disclosed in U.S. Pat. No. 5,366,012, issued Nov. 22, 1994 to Lohbeck, the folded tubing types of U.S. Pat. No. 3,489,220, issued Jan. 13, 1970 to Kinley, U.S. Pat. No. 5,337,823, issued Aug. 16, 1994 to Nobileau, U.S. Pat. No. 3,203,451, issued Aug. 31, 1965 to Vincent, the expandable sand screens disclosed in U.S. Pat. No. 5,901,789, issued May 11, 1999 to Donnelly et al., U.S. Pat. No. 6,263,966, issued Jul. 24, 2001 to Haut et al., PCT Application No. WO 01/20125 A1, published Mar. 22, 2001, U.S. Pat. No. 6,263,972, issued Jul. 24, 2001 to Richard et al., as well as the bi-stable cell type expandable tubing disclosed in U.S. patent application Ser. No. 09/973,442, filed Oct. 9, 2001. Each length of expandable tubing may be a single joint or multiple joints.

Figure 9:
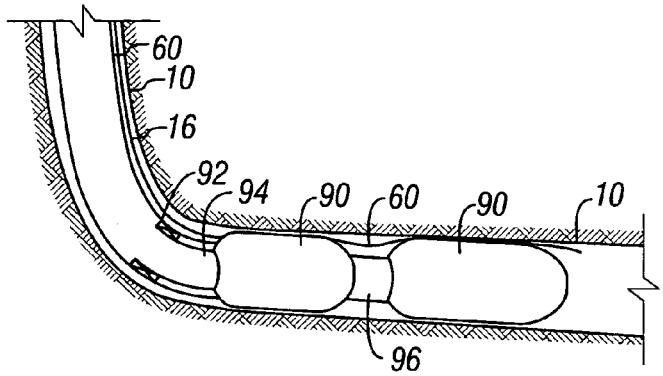
FIGS. 9 and 10 illustrate wells having expandable tubings and control lines therein.

Referring to FIG. 9, a well 10 has a casing 16 extending to an open-hole portion. At the upper end of the expandable tubing 90 is a hanger 92 connecting the expandable tubing 90 to a lower end of the casing 16. A crossover section 94 connects the expandable tubing 90 to the hanger 92. Note that any other known method of connecting an expandable tubing 90 to a casing 16 may be used or the expandable tubing 90 may remain disconnected from the casing 16. FIG.

9 is but one illustrative embodiment. In one embodiment, the expandable tubing 90 (connected to the crossover section 94) is connected to another expandable tubing 90 by an unexpanded, or solid, tubing 96. Note that the unexpanded tubing is provided for purposes of illustration only and other completions may omit the unexpanded tubing 96. A control line 60 extends from the surface and through the expandable tubing completion. FIG. 9 shows the control line 60 on the outside of the expandable tubing 90 although it could run through the wall of the expandable tubing 90 or internal to the expandable tubing 90. In one embodiment, the control line 60 is a fiber optic line that is bonded to the expandable tubing 90 and used to monitor the expansion of the expandable tubing 90. For example, the fiber optic line could measure the temperature, the stress, and/or the strain applied to the expandable tubing 90 during expansion. Such a system would also apply to a multilateral junction that is expanded. If it is determined, for example, that the expansion of the expandable tubing 90 or a portion thereof is insufficient (e.g., not fully expanded), a remedial action may be taken. For example, the portion that is not fully expanded may be further expanded in a subsequent expansion attempt, also referred to as reexpanded.

In addition, the control line 60 or intelligent completions device 62 provided in the expandable tubing may be used to measure well treatments (e.g., gravel pack, chemical injection, cementing) provided through or around the expandable tubing 90.

Figure 10:
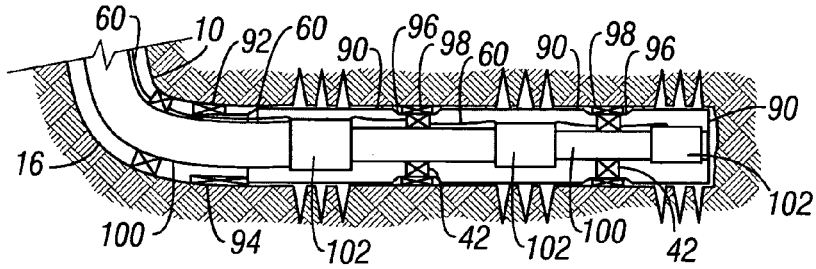

FIG. 10 illustrates an alternative embodiment of the present invention in which a plurality of expandable tubings 90 are separated by unexpanded tubing sections 96. As in the embodiment of FIG. 9, the expandable tubing 90 is connected to the casing 16 of the well 10 by a hanger 92 (which may be a packer). The expandable tubing sections 90 are aligned with separate perforated zones and expanded. Each of the unexpanded tubing sections 96 has an external casing packer 98 (also referred to generally herein as a "seal") thereon that provides zonal isolation between the expandable tubing sections 90 and associated zones. Note that the external casing packer 98 may be replaced by other seals 28 such as an inflate packer, a formation packer, and or a special elastomer or resin. A special elastomer or resin refers to an elastomer or resin that undergoes a change when exposed to the wellbore environment or some other chemical to cause the device to seal. For example, the elastomer may absorb oil to increase in size or react with some injected chemical to form a seal with the formation. The elastomer or resin may react to heat, water, or any method of chemical intervention.

In one embodiment the expandable tubing sections 90 are expandable sand screens and the expandable completion provides a sand face completion with zonal isolation. The expandable tubing sections and the unexpanded tubing sections may be referred to generally as an outer conduit or outer completion. In the embodiment of FIG. 10, the zonal isolation is completed by an inner completion inserted into the expandable completion. The inner completion comprises a production tubing 100 extending into the expandable completion. Packers 42 positioned between each of the zones to isolate the production of each zone and allow separate control and monitoring. It should be noted that the packers 42 may be replaced by seal bores and seal assemblies or other devices capable of creating zonal isolation between the zones (all of which are also referred to generally herein as a "seal"). In the embodiment shown, a valve 102 in the inner completion provides for control of fluid flow from the associated formation into the production tubing 100. The valve 102 may be controlled from the surface or a downhole controller by a control line 60.

Note that the control line 60 may comprise a fiber optic line that provides functionality and facilitates measurement of flow and monitoring of treatment and production. Although shown as extending between the inner and outer completions, the control line 60 may extend outside the outer completions or internal to the components of the completions equipment.

Figure 11:
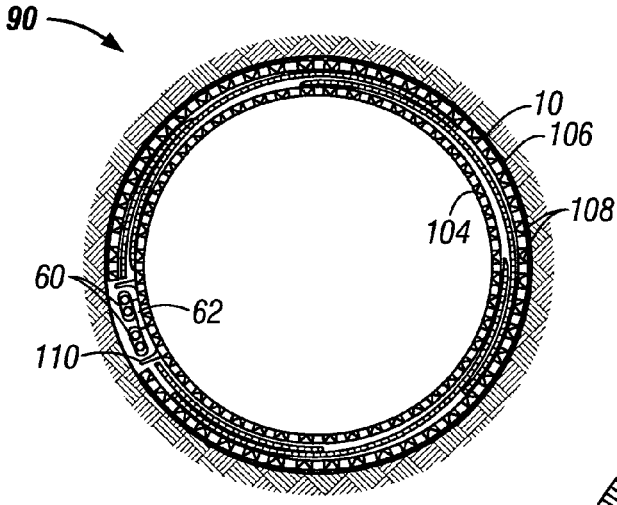
FIGS. 11 and 12 are cross sectional views of an expandable tubing of the present invention showing numerous alternative designs.

As one example of an expandable screen 90, FIGS. 11 illustrates a screen 28 that has an expandable base pipe 104, an expandable shroud 106, and a series of scaled filter sheets 108 therebetween providing the filter media 104. Some of the filter sheets are connected to a protective member 110 which is connected to the expandable base pipe 104. The FIG. shows, for illustration purposes, a number of control lines 60 and an intelligent completions device 62 attached to the screen 28.

Figure 12:
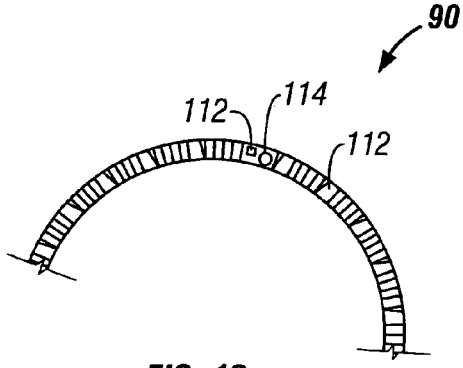

FIG. 12 illustrates another embodiment of the present invention in which an expandable tubing 90 has a relatively wider unexpanding portion (e.g., a relatively wider thick strut in a bistable cell). One or more grooves 112 extend the length of the expandable tubing 90. A control line 60 or intelligent completions device 62 may be placed in the groove 112 or other area of the expandable tubing. Additionally, the expandable tubing 90 may form a longitudinal passageway 114 therethrough that may comprise or in which a control line 60 or intelligent completions device 62 may be placed.

In addition to the primary screens 28 and expandable tubing 90, the control lines 60 must also pass through connectors 120 for these components. For expandable tubing 90, the connector 120 may be formed very similar to the tubing itself in that the control line may be routed in a manner as described above.

One difficulty in routing control lines through adjacent components involves achieving proper alignment of the portions of the control lines 60. For example, if the adjacent components are threaded it is difficult to ensure that the passageway through one components will align with the passageway in the adjacent component. One manner of accomplishing proper alignment is to use a timed thread on the components that will stop at a predetermined alignment and ensure alignment of the passageways. Another method of ensuring alignment is to make up the passageways after the components have been connected. For example, the control line 60 may be clamped to the outside of the components. However, such an arrangement does not provide for the use of passageways or grooves formed in the components themselves and may require a greater time and cost for installation. Another embodiment that does allow for incorporation of passageways in the components uses some form of non-rotating connection.

Figure 13:
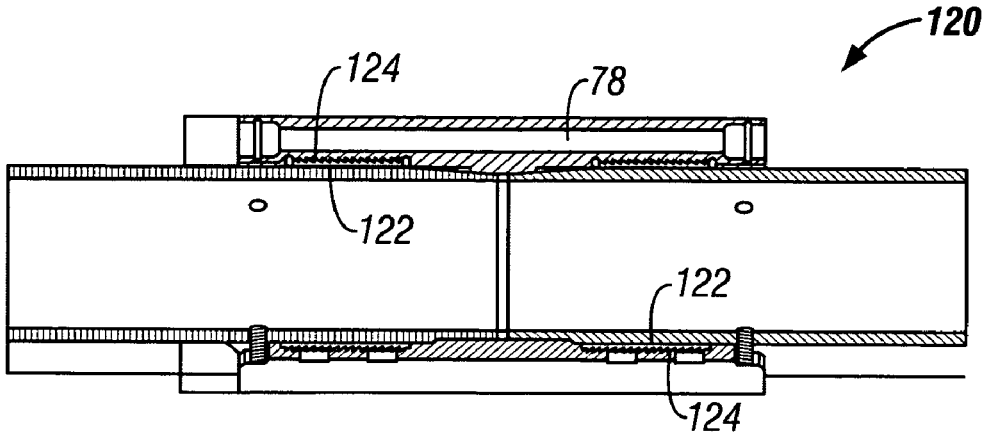
FIGS. 13 through 15 illustrate numerous alternatives for connectors of the present invention.
Figure 14:
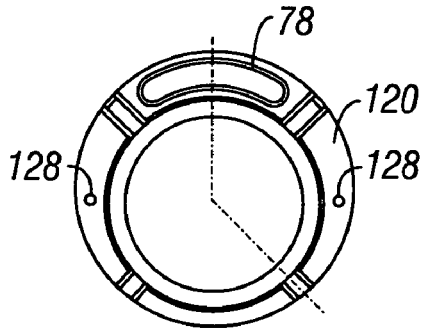

One type of non-rotating connector 120 is shown in FIGS. 13 and 14. The connector 120 has a set of internal ratchet teeth 122 that mate with external ratchet teeth 124 formed on the components to be connected. For example, adjacent screens 28 may be connected using the connector 120. Seals 126 between the connector 120 and components provide a sealed system. The connector 120 has passageways 128 extending therethrough that may be readily aligned with passageways in the connected equipment. Although shown as a separate connector 120, the ratchets may be formed on the ends of the components themselves to achieve the same resultant non-rotating connection.

Figure 15:
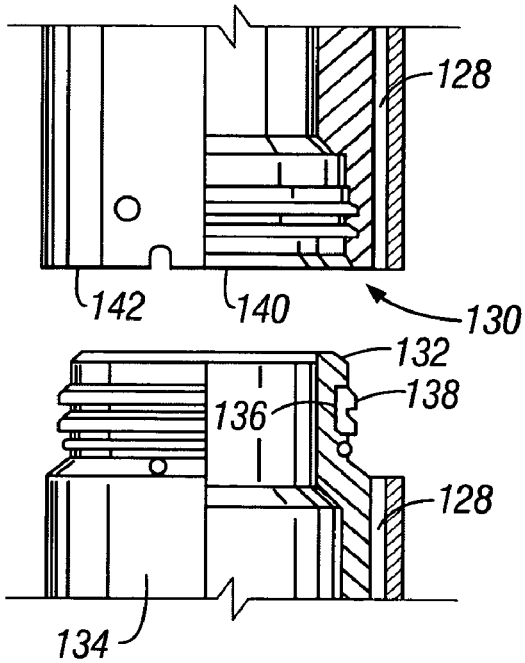

Another type of non-rotating connection is a snap fit connection 130. As can be best seen in FIG. 15, the pin end 132 of the first component 134 has a reduced diameter portion at its upper end, and an annular exterior groove 136 is formed in the reduced diameter portion above an O-ring sealing member externally carried thereon. A split locking ring member 138, having a ramped and grooved outer side surface profile as indicated, is captively retained in the groove 136 and lockingly snaps into a complementarily configured interior side surface groove 140 in the box end 142 of the second component 135 when the pin end 132 is axially inserted into the box end 142 with the passageway 128 of the pin end 132 in circumferential alignment that of the box end 142. Although shown as formed on the ends of the components themselves the snap fit connectors 130 may be employed in an intermediate connector. 120 to achieve the same resultant non-rotating connection.

In one embodiment, a control line passageway is defined in the well. Using one of the routing techniques and equipment previously described. A fiber optic line is subsequently deployed through the passageway (e.g., as shown in U.S. Pat. No. 5,804,713). Thus, in an example in which the non-rotating couplings 120 are used, the fiber optic line is blown through the aligned passageways formed by the non-rotating connections. Timed threads may be used in the place of the non-rotating connector.

Figure 16:
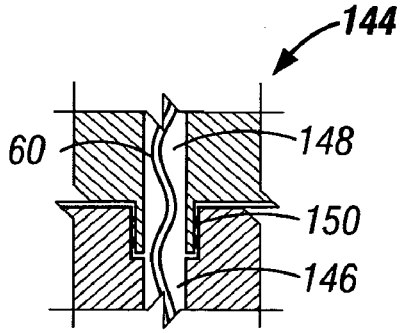
FIG. 16 illustrates a wet connect of the present invention.

Often, a connection must be made downhole. For a conventional type control line 60, the connection may be made by stabbing an upper control line connector portion into a lower control line connector portion. However, in the case of a fiber optic line that is "blown" into the well through a passageway, such a connection is not possible. Thus, in one embodiment (shown in FIG. 16), a hydraulic wet connect 144 is made downhole to place a lower passageway 146 into fluid communication with an upper passageway 148. A seal 150 between the upper and lower components provides a sealed passageway system. The fiber optic line 60 is subsequently deployed into the completed passageway.

In one exemplary operation, a completion having a fiber optic control line 60 is placed in the well. The fiber optic line extends through the region to be gravel packed (e.g., through a portion of the screen 28 as shown in the figures). A service tool is run into the well and a gravel pack slurry is injected into the well using a standard gravel pack procedure as previously described. The temperature is monitored using the fiber optic line during the gravel pack operation to determine the placement of the gravel in the well. Note that in one embodiment, the gravel is maintained at a first temperature (e.g., ambient surface temperature) before injection into the well. The temperature in the well where the gravel is to be placed is at a second temperature that is higher than the first temperature. The gravel slurry is then injected into the well at a sufficient rate that it reaches the gravel pack area before its temperature rises to the second temperature. The temperature measurements provided by the fiber optic line are thus able to demonstrate the placement of the gravel in the well.

If it is determined that a proper pack has not been achieved, remedial action may be taken. In one embodiment, the gravel packed zone has an isolation sleeve, intelligent completions valve, or isolation valve therein that allows the zone to be isolated from production. Thus, if a proper gravel pack is not achieved, the remedial action may be to isolate the zone from production. Other remedial action may comprise injecting more material into the well.

In an alternative embodiment, sensors are used to measure the temperature. In yet another alternative embodiment, the fiber optic line or sensors are used to measure the pressure, flow rate, or sand detection. For example, if sand is detected during production, the operator may take remedial action (e.g., isolating or shutting in the zone producing the sand). In another embodiment, the sensors or fiber optic line measure the stress and/or strain on the completion equipment (e.g., the sand screen 28) as described above. The stress and strain measurements are then used to determine the compaction of the gravel pack. If the gravel pack is not sufficient, remedial action may be taken.

In another embodiment, a completion having a fiber optic line 60 (or one or more sensors) is placed in a well. A proppant is heated prior to injection into the well. While the proppant is injected into the well, the temperature is measured to determine the placement of the proppant. In an alternative embodiment the proppant has an initial temperature that is lower than the well temperature.

Similarly, the fiber optic line 60 or sensors 62 may be used to determine the placement of a fracturing treatment, chemical treatment, cement, or other well treatment by measuring the temperature or other well characteristic during the injection of the fluid into the well. The temperature may be measured during a strip rate test in like manner. In each case remedial action may be taken if the desired results are not achieved (e.g., injecting additional material into the well, performing an additional operation). It should be noted that in one embodiment, a surface pump communicates with a source of material to be placed in the well. The pump pumps the material from the source into the well. Further, the intelligent completions device (e.g., sensor, fiber optic line) in the well may be connected to a controller that receives the data from the intelligent completions device and provides an indication of the placement of the placement position using that data. In one example, the indication may be a display of the temperature at various positions in the well.

Figure 17A:
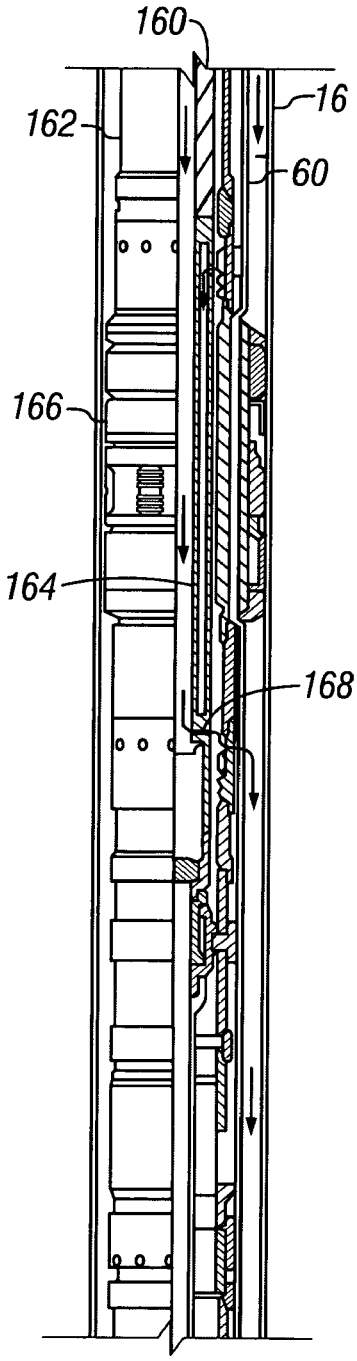
FIGS. 17A–C illustrate a service string and well operation of the present invention.
Figure 17B:
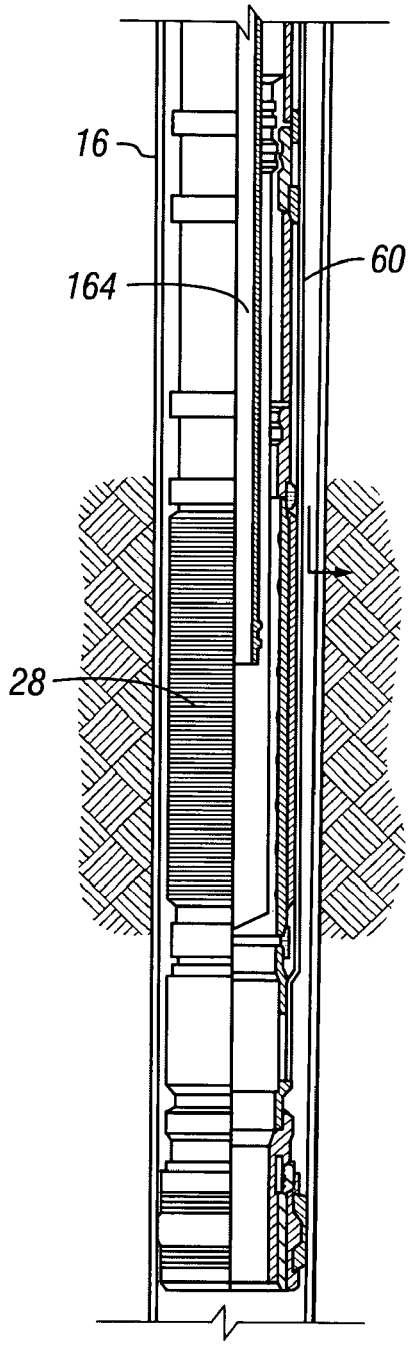

Referring now to FIGS. 17A and 17B, a service string 160 is shown disposed within the production tubing 162 and connected to a service tool 164. The service string 160 may be any type of string known to those of skill in the art, including but not limited to jointed tubing, coiled tubing, etc. Likewise, although shown as a thru-tubing service tool, the present invention may employ any type of service tool and service string. For example, the service tool 164 may be of the type that is manipulated by movement of the service tool 164 relative to the upper packer 166. A gravel pack operation is performed by manipulating the service tool 164 to provide for the various pumping positions/operations (e.g., circulating position, squeeze position, and reversing position) and pumping the gravel slurry.

Figure 17C:
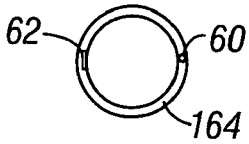

As shown in the FIGS, a control line 60 extends along the outside of the completion. Note that other control line routing may be used as previously described. In addition, a control line 60 or intelligent completions device 62 is positioned in the service tool 164. In one embodiment, the service tool 164 comprises a fiber optic line 60 extending along at least a portion of the length of the service tool 164. As with the routing of the control line 60 in a screen 28, the control line 60 may extend along a helical or other non-linear path along the service tool 164. FIG. 17C shows an exemplary cross section of the service tool 164 showing a control line 60 provided in a passageway of a wall thereof. The FIG. also shows an alternative embodiment in which the service tool 164 has a sensor 62 therein. Note that the control line 60 or sensor 62 may be placed in other positions within the service tool 164.

In one embodiment of operation, the fiber optic line in the service tool 164 is used to measure the temperature during the gravel packing operation. As an example, this measurement may be compared to a measurement of a fiber optic line 60 positioned in the completion to better determine the placement of the gravel pack. The fiber optic lines 60 may be replaced by one or more sensors 62. For example, the service tool 164 may have a temperature sensor at the outlet 168 that provides a temperature reading of the gravel slurry as it exits the service tool. Note that other types of service tools (e.g., a service tool for fracturing, delivering a proppant, delivering a chemical treatment, cement, etc.) may also employ a fiber optic line or sensor therein as described in connection with the gravel pack service tool 164.

In each of the monitoring embodiments above, a controller may be used to monitor the measurements and provide an interpretation or display of the results.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

We claim:

1. A method for monitoring a well operation, comprising:
running a service tool into the well;
delivering a material through the service tool;
monitoring a characteristic of the material with the service tool;
measuring a well characteristic using one or more of a sensor and a fiber optic line that is separate from the service tool; and
comparing the characteristic measured by the service tool to the well characteristic.

2. The method of claim 1, wherein monitoring is performed using one or more of a sensor and a fiber optic line in the service tool.

3. The method of claim 1, further comprising monitoring the material exiting the service tool.

4. The method of claim 1, wherein running comprises running a thru-tubing service tool into the well.

5. The method of claim 1, wherein monitoring comprises using a fiber optic line in the service tool.

6. The method of claim 5, wherein using comprises running the fiber optic line along a nonlinear path.

7. The method of claim 5, wherein using comprises running the fiber optic line along a generally helical path.

8. The method of claim 1, wherein monitoring comprises monitoring temperature.

9. The method of claim 1, wherein delivering comprises delivering a gravel slurry.

10. A method of servicing a well, comprising:
utilizing an intelligent service tool to deliver a gravel slurry to a desired location in a well; and
monitoring the material at the service tool during delivery of the gravel slurry.

11. The method of claim 10, wherein monitoring comprises measuring a temperature of the material gravel slurry.

12. The method of claim 10, wherein monitoring comprises utilizing a sensor disposed within the service tool.

13. The method of claim 10, wherein monitoring comprises utilizing a fiber optic disposed within the service tool.

14. The method of claim 10, further comprising connecting the intelligent service tool to a service string and deploying the service string within a production tubing.

15. A system for monitoring a well operation, comprising:
means for running a service tool into the well;
means for delivering a gravel slurry through the service tool; and
means for monitoring a characteristic of the gravel slurry with the service tool.

16. The system of claim 15, wherein the means for running comprises a service string.

17. The system of claim 15, wherein the means for delivering comprises a service tool outlet.

18. The system of claim 15, wherein the means for monitoring comprises a sensor disposed within the service tool.

19. A method for monitoring a well operation, comprising:
running a service tool into the well;
delivering a gravel slurry through the service tool;
monitoring a characteristic of the gravel slurry with the service tool.

20. The method of claim 19, wherein monitoring is performed using one or more of a sensor and a fiber optic line in the service tool.

21. The method of claim 19, further comprising monitoring the gravel slurry exiting the service tool.

22. The method of claim 19, wherein running comprises running a thru-tubing service tool into the well.

23. The method of claim 19, wherein monitoring comprises using a fiber optic line in the service tool.

24. The method of claim 23, wherein using comprises running the fiber optic line along a nonlinear path.

25. The method of claim 23, wherein using comprises running the fiber optic line along a generally helical path.

26. The method of claim 19, wherein monitoring comprises monitoring temperature.

* * * * *